United States Patent [19]

Trimble

[11] 4,431,321

[45] Feb. 14, 1984

[54] COMPUTER CONTROLLED MARKING APPARATUS

[75] Inventor: Roy L. Trimble, Theodosia, Mo.

[73] Assignee: Product Identification Corporation, Chicago, Ill.

[21] Appl. No.: 343,972

[22] Filed: Jan. 29, 1982

[51] Int. Cl.[3] ..... B41J 3/40

[52] U.S. Cl. ..... 400/130; 400/134; 400/320

[58] Field of Search ..... 400/130, 128, 129, 131, 400/134, 134.1, 134.3, 70, 320; 101/4, 18, 42

[56] References Cited

U.S. PATENT DOCUMENTS

| | | | |
|---|---|---|---|
| 1,690,442 | 11/1928 | Chisholm | 400/134.1 X |
| 3,945,479 | 3/1976 | Wvetig | 400/131 |
| 4,177,471 | 12/1979 | Mitchell | 400/320 X |
| 4,180,338 | 12/1979 | LaManna et al. | 400/130 X |
| 4,214,520 | 7/1980 | Eissel | 101/4 |

OTHER PUBLICATIONS

Schmidt Catalog, "Nameplate Marking and Numbering Equipment" pp.21–26.

*Primary Examiner*—Clifford D. Crowder
*Attorney, Agent, or Firm*—Dressler, Goldsmith, Shore, Sutker & Milnamow, Ltd.

[57] ABSTRACT

A computer-controlled mechanism in which the setting of a computer indexes a marking dial to the proper setting. The marking dial is formed as part of a unitary assembly including a character orienting motor and marking cylinder, which assembly is moved relative to the main frame support by a rack and pinion arrangement. The car frame is secured to the main frame member by a clamping mechanism.

6 Claims, 3 Drawing Figures

COMPUTER CONTROLLED MARKING APPARATUS

This invention relates to a portable, self-contained marking apparatus for imprinting automobile frame and body members. The indexing of the numbering dial is accomplished by a computer control mechanism which provides for high-speed efficient marking. The apparatus is relatively light in weight and can be utilized readily at various stations.

Marking mechanisms of this general type have heretofore been quite bulky and could not be rapidly operated to mark a large number of frames in a relatively short time. Indexing of the numbering head in machines of this general type usually consisted of manually operated levers, which needless to say made for a very slow operation. The industry has long desired to have available to it a marking machine which contains all the necessary components, yet can be readily handled and moved from place to place if desired without difficulty. Also, the availability of a relatively low-cost machine for handling the necessary functions at relatively high speeds has long been an industry requirement.

In accordance with the present invention, there is provided a marking mechanism that operates at a high rate of speed by providing a computer-controlled, rapid-acting mechanism for indexing the numbering head. The marking dial, character-orienting motor, and marking cylinder are provided as a unitary assembly which can be readily indexed to provide for the desired marking indicia on the frame member to be marked. The indexing is accomplished by a simple rack and gear mechanism, and the frame member is retained in place by a suitably positioned clamping cylinder which can be operated to readily clamp and unclamp the workpiece in position relative to the apparatus. The operation of the apparatus essentially consists of locating the apparatus in position on the frame or body, after which the clamping mechanism is energized and the label data is input into the computer. This data is displayed and immediately thereafter the print cycle is initiated, with the result that the print wheel is moved to the proper character and the marking cylinder is energized to imprint the selected character. Thereafter, the indexing motor is operated to provide lateral motion of the movable assembly to the next marking position, after which the print wheel is recycled and subsequent characters are provided on the marking plate. After all the characters have been printed, the print head is returned to its starting position and the clamping signal is terminated to release the clamp and provide for removal of the apparatus from the part.

The components of the apparatus can be seen by referring to the following drawings.

Figure 1:
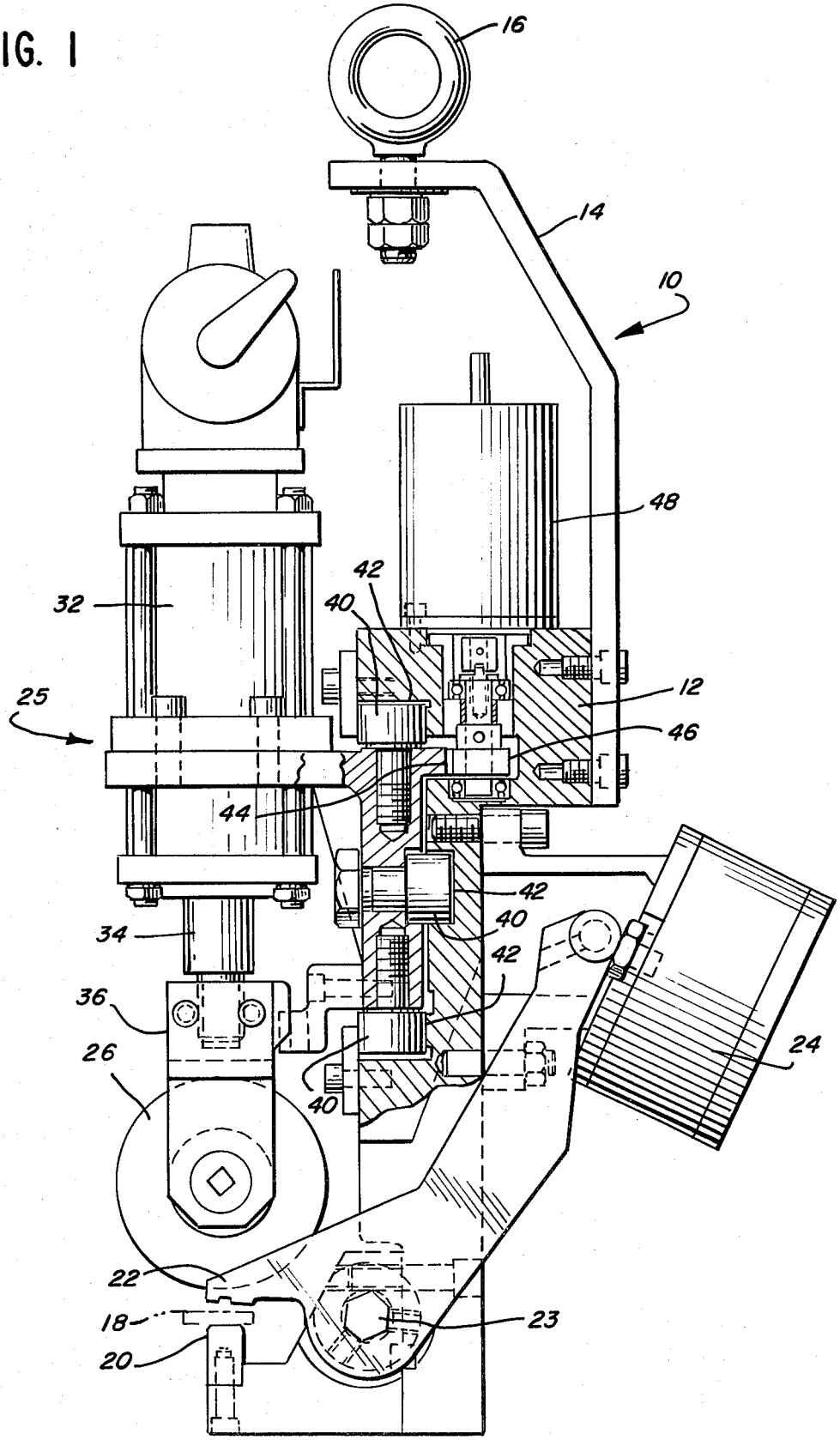
FIG. 1 is a side elevation view partially broken away to show the mountings of the various mechanisms on the main frame structure.
Figure 2:
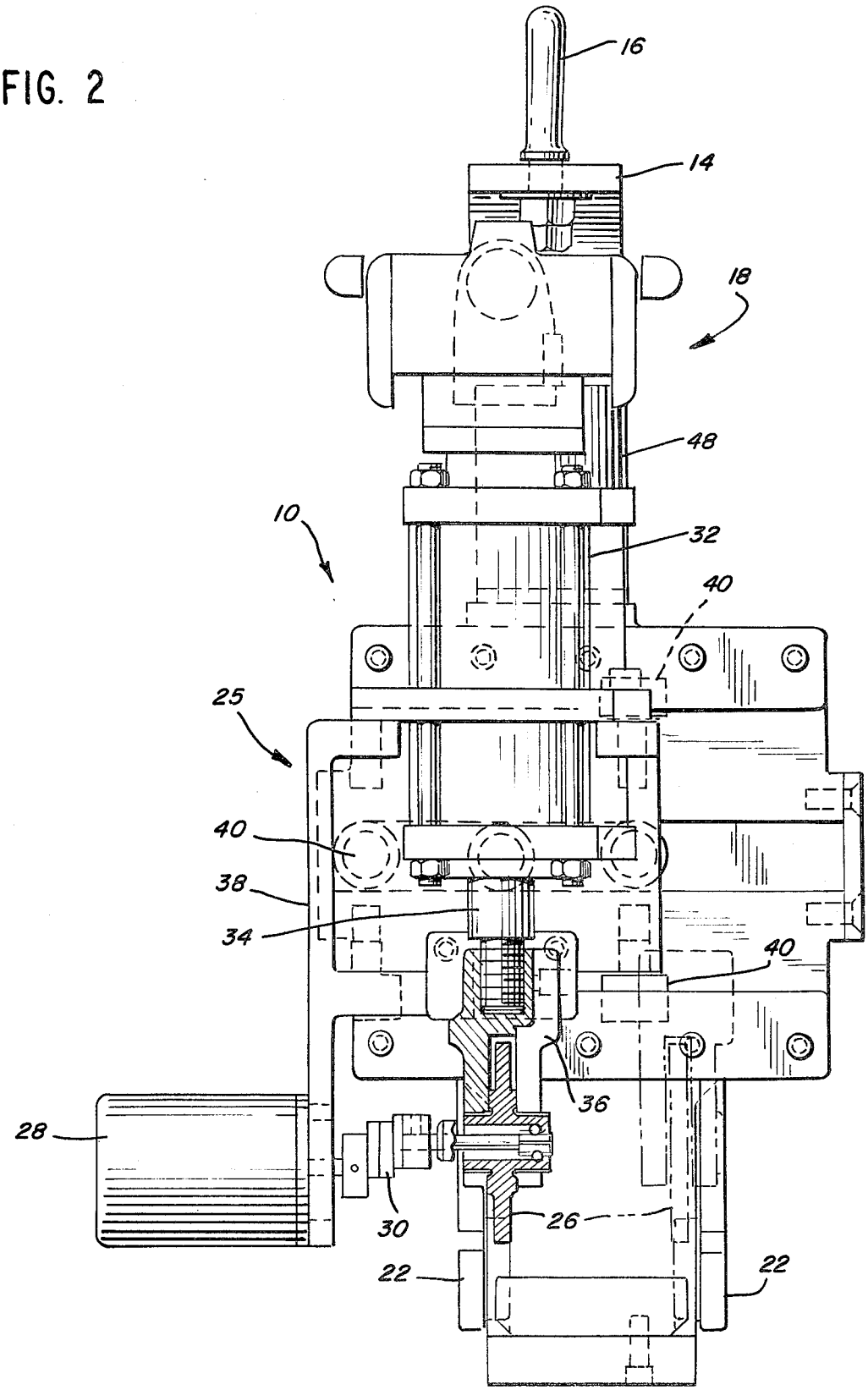
FIG. 2 is a view taken at 90 degrees to FIG. 1 and partially broken away to show various components thereof.

Referring now to the figures, there is shown in FIG. 1 the marking apparatus indicated at 10. This apparatus consists of a main frame structure 12, which provides the support for the various components making up the marking apparatus. Secured to the frame 12 is a bracket

14, at one end of which is connected a ring 16 that can be hung on balancers to support the weight of the apparatus, which is normally in the vicinity of 75 lbs.

The frame to be marked is indicated in dotted lines at 18 and is adapted to be supported on an anvil 20 and affixed relatively thereto by transversely spaced clamps 22. The clamps are pivotally mounted at 23 to the main frame member and are actuated by the clamping cylinder 24.

There is provided a transversely movable marking dial or character-orienting motor marking cylinder assembly 25, which is unitary and is supported for transverse and reciprocal movement relative to the main frame structure 12 and frame or workpiece 18 being marked. The marking dial 26 contains a plurality of marking characters and is positioned by a character orienting motor 28, which is interconnected to the marking dial 26 through the transmission 30. The character-orienting motor 28 is operated by a computer mechanism which is operated by a keyboard and includes suitable display mechanisms to show the characters that are to be imprinted on the frame. The details of such a control circuit and computer control mechanism are fully disclosed in application Ser. No. 183,175, entitled "Marking Machine Control System," filed Sept. 2, 1980, and assigned to the assignee of the present invention. The details of such control mechanism are incorporated here by reference and are intended to be illustrative of various types of computer control mechanisms that can be employed to index the dial to provide for suitable marking indicia on a marking plate.

The reciprocal movement of the marking dial is accomplished by a marking cylinder 32 that is interconnected to the marking dial through a rod 34 and bracket 36. The marking dial is free to be suitably supported relative to the bracket 36 and is free to be rotated to the proper character by the character-orienting motor 28, which as aforementioned is controlled by a computer control mechanism, as described above.

As previously mentioned, it is necessary to move the marking dial in a transverse direction relative to the plate to be marked to provide for the proper marking arrangement on the plate to be marked. This is accomplished by mounting the marking cylinder, character-orienting motor, and marking dial assembly 25 in a manner so that it can be transversely moved relative to the main frame 12, but will be supported thereby. It is to be noted in this regard that the character-orienting motor 28 is suitably supported relative to the aforementioned assembly 25 by a support bracket 38.

In order to support the assembly 25 relative to the main frame, there are provided a plurality of horizontally and vertically disposed rollers 40 which are free to move in guideways 42 provided by the frame 12. The movement of the assembly 25 is accomplished through a rack member 44 which is part of the assembly 25 and a pinion 46 which is driven by indexing motor 48, that is affixed to the frame 12. Thus, it can be appreciated that operation of the indexing motor 48 will move the assembly 25 transversely relative to main frame structure 12 and frame or workpiece 18 retained in fixed position relative to main frame structure 12 by clamps 22. This moves the indexing wheel 26 to the requisite positions after each character has been imprinted on the name plate.

Figure 3:
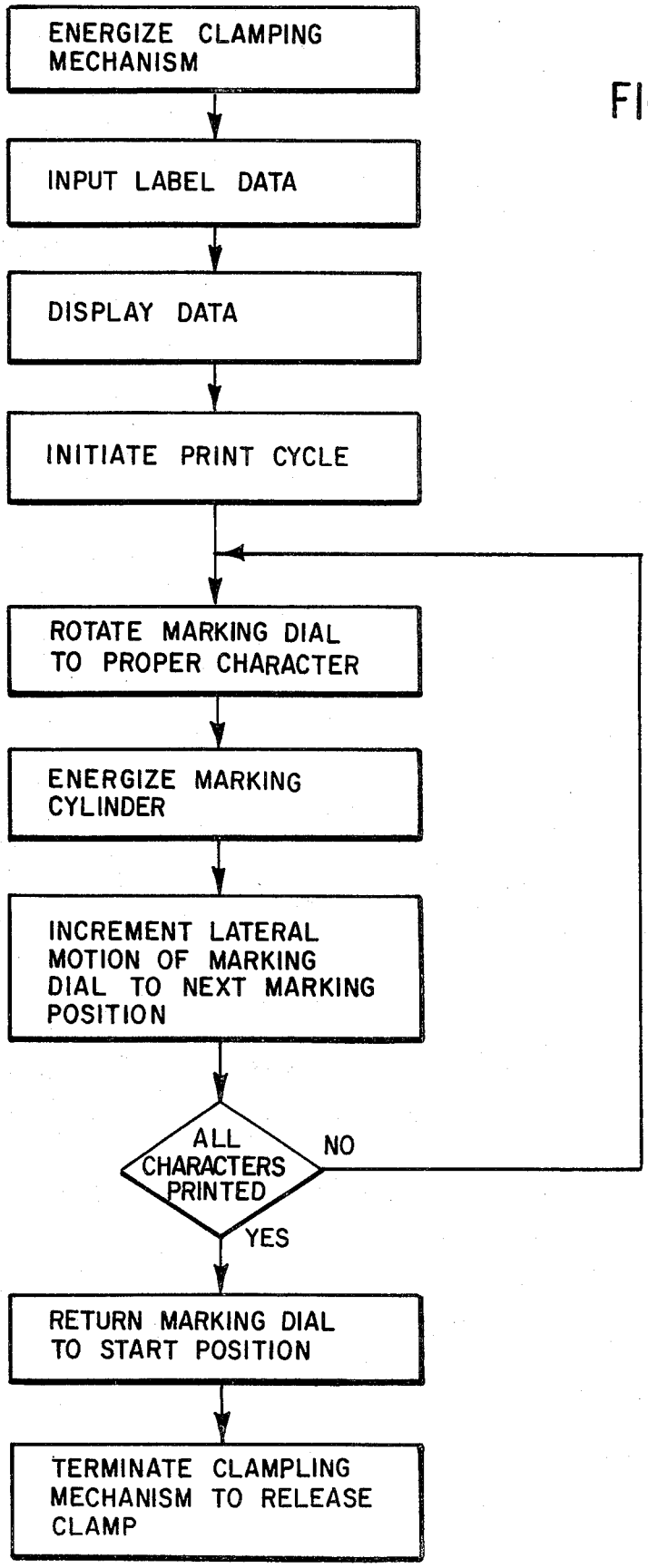
FIG. 3 is a flow chart showing the operation of the mechanism.

A clear understanding will be obvious from the following description of the method of operation, which will be described in conjunction with the flow chart shown in FIG. 3.

Essentially, after the apparatus is placed in position on the frame member, the clamping cylinder 24 is energized to clamp the plate in position to be marked. The computer control mechanism, by virtue of a keyboard operation, is actuated to input the desired label data and the data will be displayed on a conventional display mechanism. After this occurs, the print cycle is initiated, which results in the character-orienting motor 28 being controlled by the computer control mechanism to move the wheel to the proper character. When this occurs, the marking cylinder 32 is operated to provide a downward imprinting movement of the print wheel 26 to contact with the name plate to be marked at a marking pressure on the order of 1 ton. After this occurs, the marking cylinder is returned to its position and if there are subsequent characters to be printed, the print wheel is recycled and the requisite number of characters are printed, after which the print head is returned to a start position and the clamping mechanism is released to permit removal of the apparatus from the frame member.

It is submitted that the apparatus as described is intended to be exemplary of that which can be used and it is intended to cover by the appended claims all such modifications and variations which fall within the scope thereof.

What is claimed is:

1. A computer controlled marking apparatus of the type adapted to be moved to a position to mark a workpiece maintained in a stationary position relative thereto comprising:

a frame structure;

means for clamping a workpiece to be marked in a fixed position relative to said frame structure including clamping arms pivotally secured to said frame structure and clamping cylinder means secured to said frame structure for operating said clamping arms to retain said workpiece in said fixed position relative to said frame structure;

a unitary assembly supported on said frame structure for lateral movement relative thereto;

means for laterally moving said unitary assembly relative to said frame structure and to a workpiece clamped in a fixed position relative to said frame structure to position said unitary assembly at successive marking positions;

a marking assembly supported by said unitary assembly for reciprocal movement toward and away from said clamped workpiece to affect marking thereof at said marking positions with selected ones of a plurality of characters;

said marking assembly including a marking dial having a plurality of marking characters thereon and moveable to a plurality of selected character positions in which a selected character may be marked on said workpiece upon reciprocal movement of said marking assemblies, and a character orienting motor secured to said marking assembly and moveable therewith and selectably energizable to move said marking dial to selected ones of said character positions; and means affixed to said unitary assembly for reciprocally moving said marking assembly to effect marking of the workpiece by said marking dial at selected ones of said marking positions with a character on said character dial located at said character position.

2. A marking apparatus as claimed in claim 1 including means for supporting the unitary assembly on said frame structure for lateral movement relative thereto, said supporting means comprising a plurality of vertically and horizontally oriented rollers disposed in a plurality of guideways defined in said frame structure.

3. Apparatus as claimed in claim 1 wherein said clamping arms are disposed laterally on either side of said marking dial to define therebetween said plurality of marking locations.

4. Apparatus as set forth in claim 1 wherein said means for laterally moving said unitary assembly comprises motor means supported on said frame structure and connected to said unitary assembly for effecting selected transverse movement thereof to successive ones of said marking positions.

5. A marking apparatus as claimed in claim 4 wherein said motor means comprises an indexing motor and said unitary assembly moving means further includes a pinion and rack secured between said indexing motor and said unitary assembly for effecting transverse movement of said unitary assembly in response to operation of said indexing motor.

6. A marking apparatus of claim in claim 1 including anvil means for supporting said workpiece thereon, said clamping cylinder means operating said clamping arms to retain said workpiece in said fixed position relative to said frame structure against said anvil means, said anvil means being disposed in alignment with said marking dial and defining therewith the plurality of marking locations.

* * * * *